US006199223B1

(12) United States Patent
Sorokin

(10) Patent No.: US 6,199,223 B1
(45) Date of Patent: Mar. 13, 2001

(54) DEVICE FOR INSTALLING LIGHTING IN AN ABOVE-GROUND SWIMMING POOL

(75) Inventor: Marvin S. Sorokin, Toronto (CA)

(73) Assignee: Consolidated Pool & Spa Industries Inc., Woodbridge (CA)

( * ) Notice: Subject to any disclaimer, the term of this patent is extended or adjusted under 35 U.S.C. 154(b) by 0 days.

(21) Appl. No.: 09/326,568

(22) Filed: Jun. 7, 1999

(51) Int. Cl.[7] ..... E04H 4/00
(52) U.S. Cl. ..... 4/496; 4/488
(58) Field of Search ..... 4/496, 488, 506, 4/498, 494, 503, 505, 510

(56) References Cited

U.S. PATENT DOCUMENTS

| | | | |
|---|---|---|---|
| D. 399,573 | 10/1998 | Stegmeier et al. . | |
| 3,526,070 | 9/1970 | Deason . | |
| 4,457,119 | 7/1984 | Dahowski . | |
| 4,901,492 | 2/1990 | Coates . | |
| 5,107,551 | 4/1992 | Weir et al. . | |
| 5,170,517 | 12/1992 | Stegmeier . | |
| 5,608,296 | 3/1997 | Donaton . | |
| 5,680,730 | 10/1997 | Epple . | |
| 5,695,586 | 12/1997 | Stegmeier . | |
| 5,720,056 | 2/1998 | Aymes . | |
| 5,791,758 | 8/1998 | Horgan et al. . | |
| 5,887,295 | 3/1999 | Williamson . | |
| 5,915,848 * | 6/1999 | Deason | 4/496 |

* cited by examiner

*Primary Examiner*—David J. Walczak
(74) *Attorney, Agent, or Firm*—Gowling Lafleur Henderson LLP

(57) ABSTRACT

A device for securing a light to an above-ground pool is provided having a web for attachment to a lip of the pool and a sheath for retaining at least one light or an entire lighting strip along the periphery of the pool. In one embodiment, the device has a bezel portion including the web and the sheath, and a clip portion which attaches to the bezel portion and for securing the device to the lip of the pool. The bezel portion can be provided with a slot and the clip provided with a base which fits into the slot and can be snappingly retained within the slot.

11 Claims, 4 Drawing Sheets

DEVICE FOR INSTALLING LIGHTING IN AN ABOVE-GROUND SWIMMING POOL

FIELD OF THE INVENTION

The present invention relates generally to accessories for swimming pools, and more particularly relates to a device for installing lighting in an above-ground swimming pool.

BACKGROUND OF THE INVENTION

Lighting systems disposed about the upper periphery of the pool, above the water level, are a common accessory for swimming pools. Copings for in-ground swimming pools are also generally disposed about the upper periphery of the pool, above the water level. While copings are generally used to interconnect the side-walls, pool liner and walkway of the in-ground pool, it is thus convenient to incorporate a lighting system with the coping. Such lighting systems can generally be conveniently incorporated into coping designs by providing appropriate channels and apertures to receive the lighting system and power connections thereto. Examples of such systems can be found in U.S. Pat. No. 5,680,730 to Epple, and U.S. Pat. No. 4,457,119 to Dohowski. However, the prior art devices are generally unsuitable for installing a light system about the periphery of an above-ground pool.

SUMMARY OF THE INVENTION

It is thus an object of the invention to provide a novel device for installing a lighting system about the periphery of an above-ground swimming pool which obviates or mitigates at least one disadvantage of the prior art. In one embodiment, there is provided a bezel for securing, lighting to an inner lip of an above-ground pool comprising a web extending along at least a portion of a length of the inner lip and having a first securing means for attachment to the lip along the length; and, a sheath depending from the web for receiving at least one light therein along the length.

In another embodiment, there is provided a device for securing lighting to an inner lip of an above-ground pool comprising: a bezel portion having a web extending along at least a portion of a length of the inner lip, a sheath depending from the web for receiving at least one light therein along the length, and a slot disposed between the web and the sheath; a clip portion having a base and a member depending from the base and biased towards the web, the member having a first securing means for affixing the device to the inner lip, the base having a second securing means for retaining the base portion when inserted into the slot.

In a particular aspect of this embodiment, the inner lip includes a channel and the first retaining means is a bead on a distal tip of the member, the bead being complementary to the channel, such that when the bead is inserted into the channel the member is biased towards the lip and the web abuts an opposite side of the lip to cooperate and affix the device to the lip.

BRIEF DESCRIPTION OF THE DRAWINGS

The present invention will now be described, by way of example only, with reference to certain embodiments and the attached figures in which.

DETAILED DESCRIPTION OF THE DRAWINGS

Figure 1:
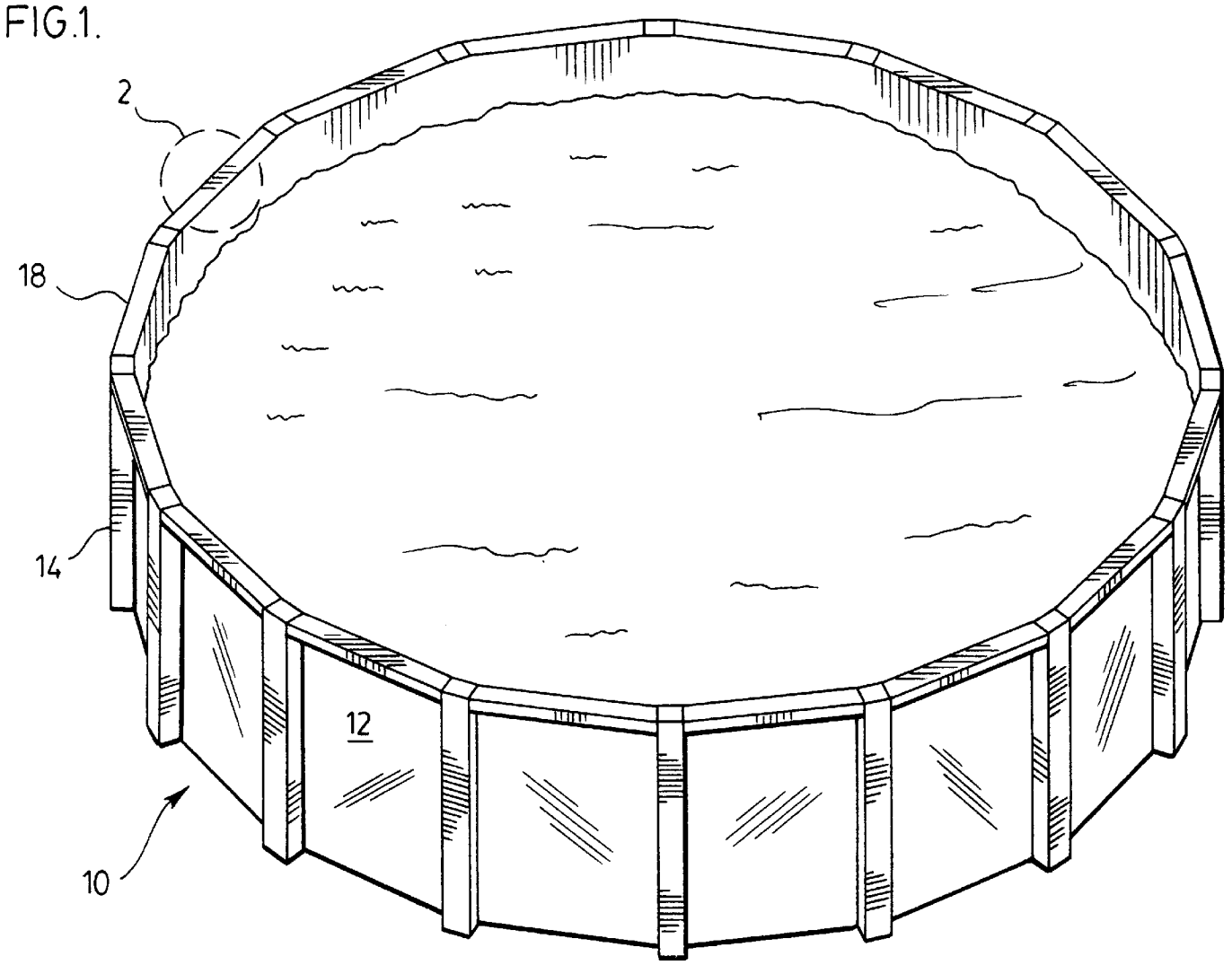
FIG. 1 is a perspective view of an above-ground swimming pool to which an embodiment of the present invention can be attached.

Referring now to FIG. 1, an above-ground swimming pool suitable for the present invention is indicated generally at 10. Pool 10 includes outer walls 12 interconnected by vertical supports 14 which collectively provide a reservoir for retaining water. Each wall 12 has an upper rail 18 attached to the top thereof, such that upper rails 18 extend about the outer periphery of pool 10, and generally above the waterline. (As used herein, terms such as above, top, bottom, front, back etc. are used for convenience and generally refer to the invention as viewed in the attached Figures, and as such are not to be construed in a limited sense.)

Figure 2:
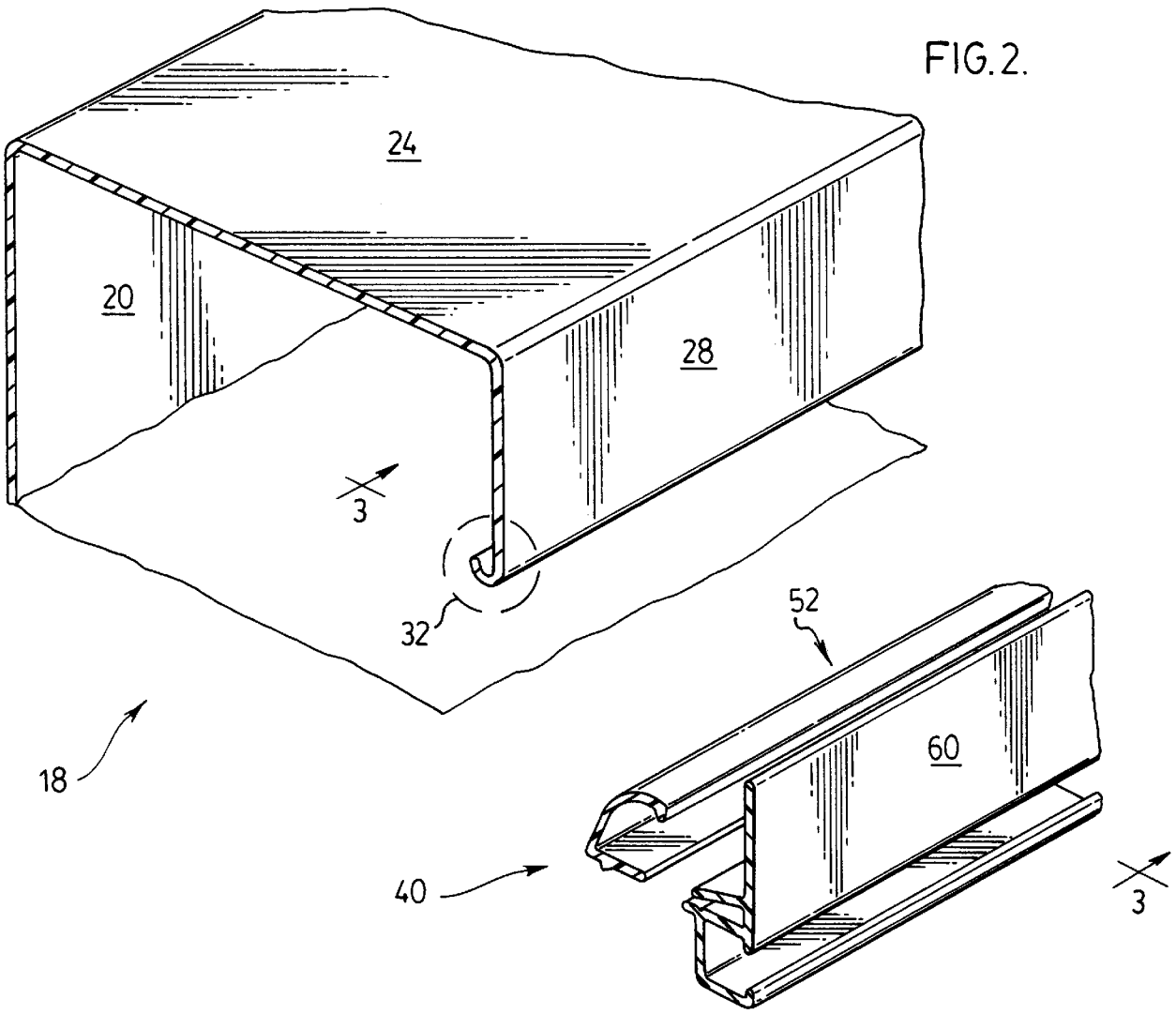
FIG. 2 is a sectional perspective view showing an enlarged portion of the upper rail of the above-ground swimming pool of FIG. 1 and a perspective sectional view of an unassembled device for installing a lighting system in accordance with an embodiment of the invention.

FIG. 2 shows rail 18 in greater detail. Rail 18 comprises an outer segment 20 attached to wall 12 (not shown in FIG. 2), a decking segment 24 extending from the top of outer segment 20, and an inner lip segment 28 extending downwards from the end of decking segment 24 opposite from outer segment 20. The bottom of lip segment 28 is curled towards outer segment 20 to define a channel 32.

Figure 3:
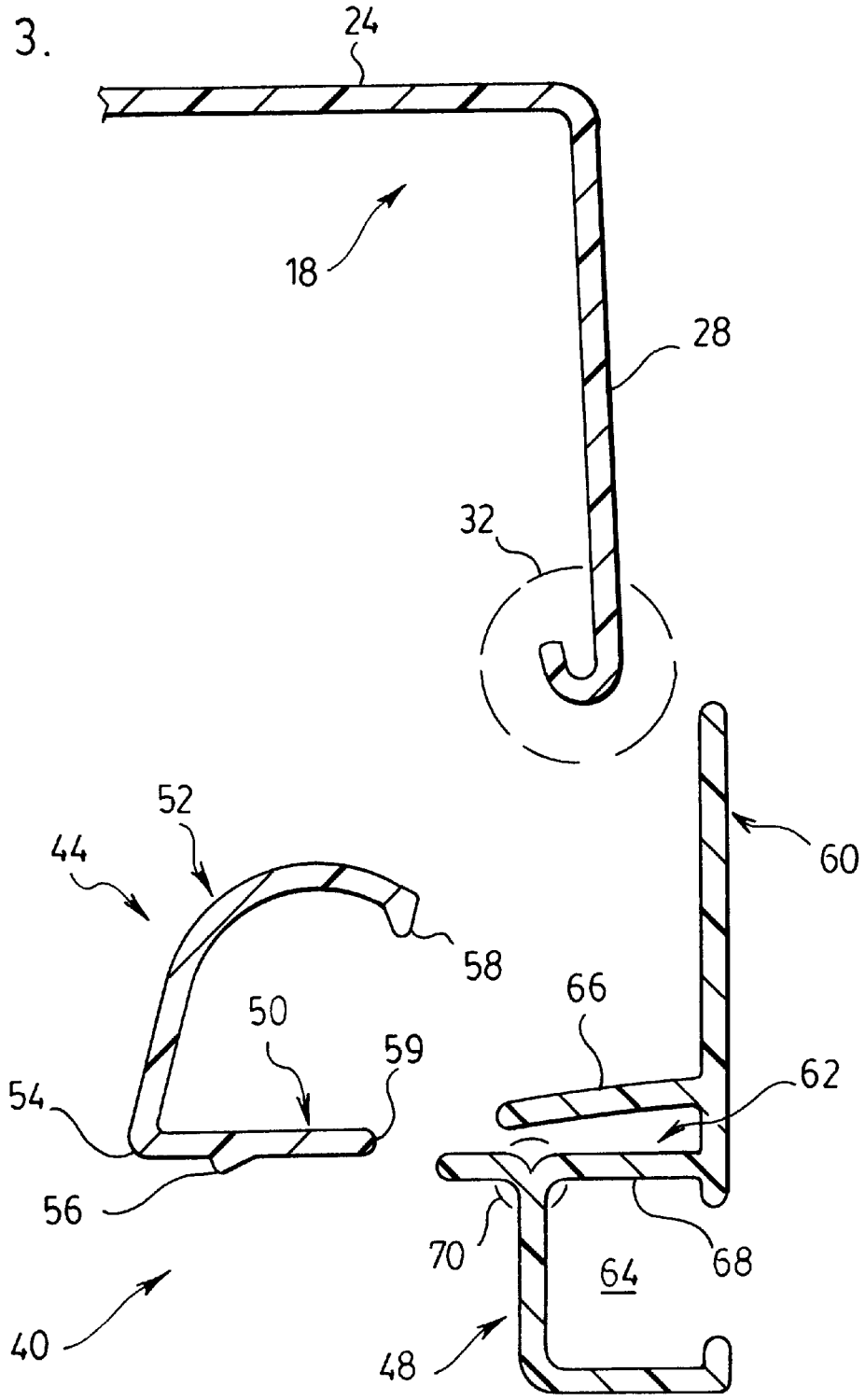
FIG. 3 is a partial side-sectional view of FIG. 2 through line 3—3.

Referring now to FIG. 3, an unassembled device for installing lighting is indicated generally at 40. Device 40 is preferably extruded from a plastic such as polyvinyl chloride ("PVC") although any suitable formation techniques and material can be, used as will occur to those of skill in the art. Device 40 comprises a retention clip 44 and a light bezel 48. As device 40 is viewed in cross-section in FIG. 3, clip 44 has a substantially flat base portion 50, and at substantially hook-shaped member 52 extending from one end 54 of base portion 50. Clip 44 further comprises a rib 56 extending along the surface of base portion 50 opposite from member 52, and a bead 58 extending along the extreme tip of member 52. Bead 58 is complementary to channel 32 to provide a first securing means therebetween. As will be discussed in greater detail below, member 52 is resiliently deformable and in a relaxed position, bead 58 is biased to extend towards the opposite end 59 of base portion 50 and generally away from base portion 50.

Light bezel 48 comprises a web 60, a slot 62 integral with and generally perpendicular to web 60, and a lighting sheath 64 depending from the exterior surface of slot 62 opposite from web 60. Slot 62 is defined by an upper lip 66 and a lower lip 68 which also defines a portion of sheath 64. Lower lip 68 has a groove 70 on the inner surface of slot 62 which is complementary to rib 56 in order to engage and releasably retain rib 56 in a snapping fit. Slot 62 and groove 70 combine with base portion 50 and rib 56 to provide a second securing means therebetween. Sheath 64 is generally C-shaped, to receive a lighting strip, such as a tube of fibre-optic cable or the like. It is to be understood that the shape of sheath 64 can be suitably modified to receive and retain various shapes and sizes of lighting strips, as will occur to those of skill in the art. For example, sheath 64 can be a hollow member made from a substantially light-transmissive material.

Figure 5:
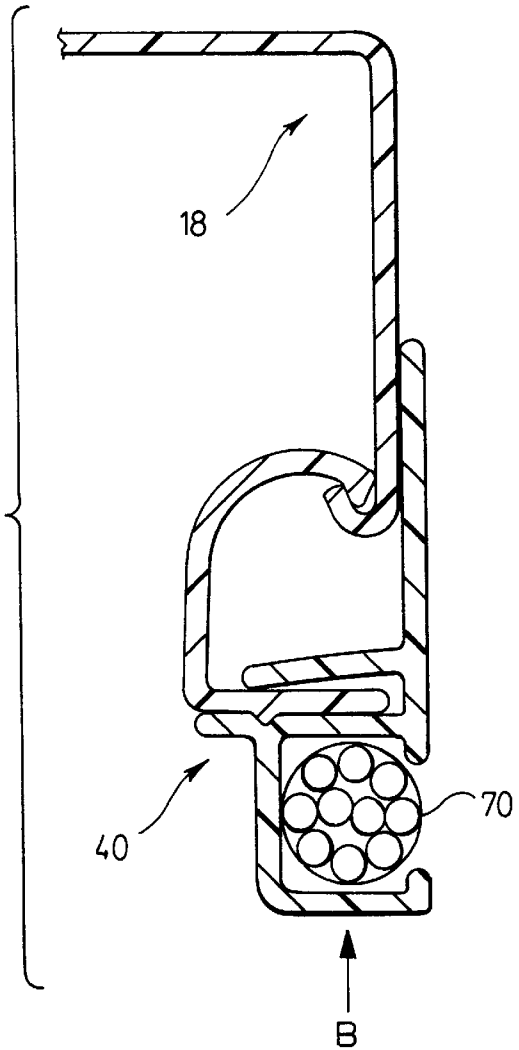
FIG. 5 is a partial side-sectional view of the rail of FIG. 3 and the device of FIG. 4 assembled to the rail.
Figure 4:
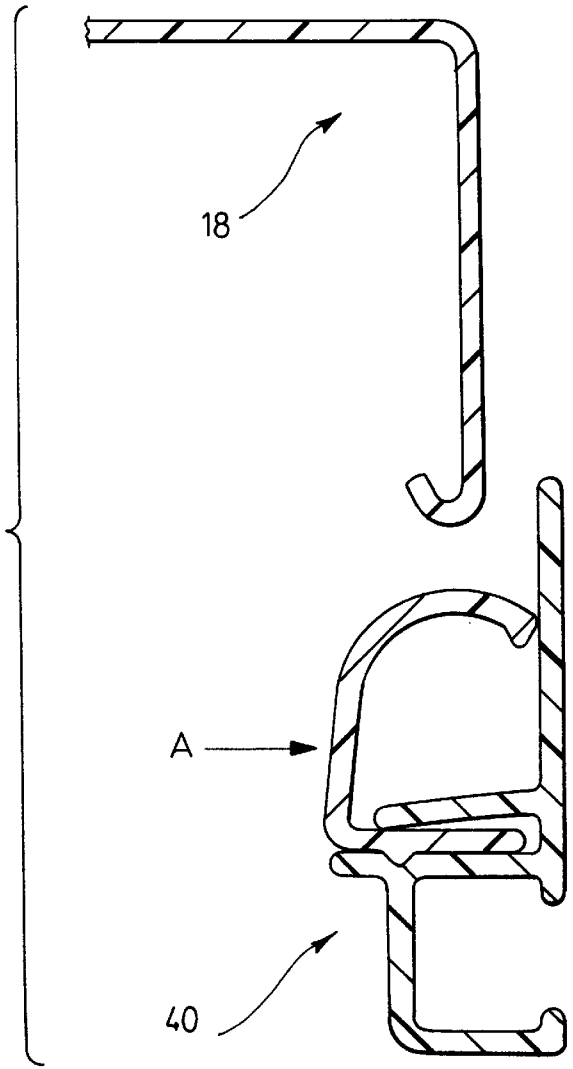
FIG. 4 is a partial side-sectional view of the rail of FIG. 3 and the device of FIG. 3 as assembled.

The assembly of device 40 onto rail 18 will now be discussed with reference to FIGS. 4 and 5. Referring first to FIG. 4, clip portion 44 is first assembled with bezel 48, by inserting the opposite end 59 of base portion 50 into slot 62 until rib 56 snaps into retained engagement with groove 70, as indicated by arrow A. At this point it can be noted that member 52 abuts web 60 and is biased thereagainst. Referring now to FIG. 5, device 40 is then positioned so that web 60 is generally parallel with lip segment 28, such that the concave surface of channel 32 is nestled between the abutment of member 52 with web 60. By applying pressure as indicated by arrow B in FIG. 5, member 52 is urged away from web 60 allowing the concave surface of channel 32 to pass therebetween. Once channel 32 has passed therethrough, member 52 urges, bead 58 into channel 32 thus securing device 40 to rail 18. Finally, a lighting strip of fibre-optic cable 70 is inserted into sheath 64 along the entire length thereof. It will now be apparent that, as in the present embodiment where pool 10 is comprised of a plurality of walls 12, cable 70 can be readily strung through a plurality of devices 40 all attached to accompanying rails 18 about the periphery of pool 10, to provide a continuous strip of light along the inner periphery of pool 10.

It will now be apparent that cable 70 can be connected to the exterior of pool 10 using any suitable means, such as through a hole formed on the interior of sheath 64 and out through a hole formed in decking 24.

In an alternative method of assembly of device 40 to rail 18, device 40 is unassembled. First, bead 58 of clip portion 44 is inserted into channel 32 of rail 18. Next, while bead 58 is maintained in position, slot 62 is slid over base 50 until rib 56 snapplingly engages into groove 70, at which point web 60 is flush with lip segment 28 and device 40 is assembled to rail 18. It will be apparent to those of skill in the art that the latter method of assembly can be appropriate where member 52 is so biased that it is difficult for channel 32 to pass between member 52 and web 60 when clip portion 44 and bezel 48 are preassembled.

While only specific combinations of the various features and components of the present invention have been discussed herein, it will be apparent to those of skill in the art that desired sub-sets of the disclosed features and components and/or alternative combinations of these features and components can be utilized, as desired. For example, clip portion 44 can be attached to bezel 48 using other mechanical interfaces other than the second securing means of the embodiments discussed herein. Similarly, member 52 and bead 58 can be varied to engage different types of channels and lips on the pool rail, as will occur to those of skill in the art. Alternatively, web 60 can be mechanically secured to lip 28, using screws, rivets or the like. It is also contemplated that sheath 64 can have a variety of configurations to accommodate different sizes and shapes of lighting strips and/or individual lights. It will also be apparent that device 40 can be provided with a curvature to extend around a complementary radiused portion of a pool. Likewise, device 40 can be one continuous strip with appropriate curves to encircle pool 10.

The present invention provides a novel device for securing lights to the rail of an aboveground pool. The device can be retrofitted onto existing outdoor pools to facilitate the installation of a lighting strip and/or individual lights. The device can also be manufactured using known techniques such as plastic extrusion, and can be installed with relative ease without the need for in-depth mechanical skills. A two-part device can be particularly useful in order to assemble the device to an existing rail, allowing the clip portion to be assembled to the rail before assembling the bezel.

What is claimed is:

1. A device for securing lighting to an inner lip of an above-ground pool, said inner lip having a channel formed thereon, said device comprising:

a web for securing to at least a portion of a length of said inner lip;

a securing means for attachment to said lip along said length, said securing means including a cooperation between said channel on said inner lip and a bead attached to a member extending from said device, said member biased towards said web such that said bead snappingly engages said channel and secures said device to said lip; and, a sheath depending from said web for receiving at least one light therein along said length.

2. The device according to claim 1 wherein said sheath is substantially C-shaped.

3. The device according to claim 1 wherein said at least one light is a fibre-optic cable.

4. A device for securing lighting to an inner lip of an above-ground pool, said inner lip having a channel formed thereon, said device comprising:

a bezel portion having a web for extending along at least a portion of a length of said inner lip, a sheath depending from said web for receiving at least one light therein along said length, and a slot disposed between said web and said sheath;

a clip portion having a base and a member extending from said base and biased towards said web, said member having a first securing means for affixing said device to said inner lip, said base having with a second securing means for retaining said base portion when inserted into said slot.

5. The device according to claim 4 wherein said clip portion is releasable from said bezel portion.

6. The device according to claim 5 wherein said slot has a groove and said second securing means is a rib complementary to said groove such that said base is snappingly engaged in said slot.

7. The device according to claim 4 wherein said first securing means is a bead on a distal tip of said member complementary to said channel, such that when said bead is inserted into said channel said member is biased towards said lip and said web abuts an opposite side of said lip to cooperate and affix said device to said lip.

8. The device according to claim 4 wherein said at least one light is a fibre optic cable.

9. The device according to claim 4 wherein said sheath is substantially C-shaped.

10. The device according to claim 4 wherein said device is formed from polyvinyl chloride.

11. A device for securing light to an inner lip of an above-ground pool, said inner lip having a length and a channel formed thereon, said device comprising:

a bezel portion having a web for extending along at least a portion of said length, a sheath depending from said web for receiving a fibre-optic cable, and a slot disposed between said web and said sheath, said slot having a groove formed therein; and a clip portion removably attachable to said bezel portion, said clip portion having a base and a member, said member extending from said base and biased towards web when assembled to said bezel portion, said member having bead formed on a distal tip thereof for cooperative engagement with said channel, said base having a rib complementary to said groove such that said base is snappingly engagable in said slot during attachment of said clip portion to said bezel portion.

* * * * *